United States Patent [19]

Yamaguchi et al.

[11] Patent Number: 4,813,905

[45] Date of Patent: Mar. 21, 1989

[54] ILLUMINATION MECHANISM FOR A TOY

[75] Inventors: Hidehiko Yamaguchi; Kouich Minami; Nobuo Kobayashi, all of Tokyo, Japan

[73] Assignee: Tomy Kogyo Company, Inc., Tokyo, Japan

[21] Appl. No.: 144,051

[22] Filed: Jan. 15, 1988

[30] Foreign Application Priority Data

Jan. 22, 1987 [JP] Japan ..... 62-7879[U]

[51] Int. Cl.[4] ..... A63H 17/28

[52] U.S. Cl. ..... 446/438; 446/242; 446/485; 362/35

[58] Field of Search ..... 446/175, 219, 242, 438, 446/439, 484, 485; 362/35, 293

[56] References Cited

U.S. PATENT DOCUMENTS

| | | | |
|---|---|---|---|
| 1,338,575 | 4/1920 | Kerr | 446/243 |
| 1,579,165 | 3/1926 | Tiencken | 446/243 |
| 2,610,442 | 9/1952 | Bonanno | 446/438 X |
| 2,688,689 | 9/1954 | Christopher | 446/485 X |
| 3,034,257 | 5/1962 | Hanna | 446/438 |
| 3,693,281 | 9/1972 | Wolf | 446/219 X |
| 4,002,893 | 1/1977 | Newcomb et al. | 446/438 X |
| 4,209,941 | 7/1980 | Bourque | 446/439 X |
| 4,228,616 | 10/1980 | Wilson | 446/439 |
| 4,465,949 | 8/1984 | Knauff | 446/438 X |

FOREIGN PATENT DOCUMENTS

| | | | |
|---|---|---|---|
| 771029 | 11/1967 | Canada | 362/293 |
| 2026331A | 2/1980 | United Kingdom | 446/439 |

*Primary Examiner*—Robert A. Hafer
*Assistant Examiner*—Samuel Rimell
*Attorney, Agent, or Firm*—Staas & Halsey

[57] ABSTRACT

An illumination mechanism for moving toys provides projection of an image to projection faces of an outer shell by using a transparent frame and light source located within the shell. An elevating frame supports a projection device for projecting additional images to surfaces external to the toy.

9 Claims, 2 Drawing Sheets

ILLUMINATION MECHANISM FOR A TOY

BACKGROUND OF THE INVENTION

1. Field of the Invention

This invention relates to an illumination mechanism used for toys and, more particularly, to a toy illumination mechanism for running toys or movable toys having a body and a projecting face thereon, and a light source placed in the body in order to project desired a pattern on the projecting face of the body.

2. Description of the Related Art

According to the conventional illumination devices, it has been known to light a head light on running toys and a warning light on a toy police car or an ambulance. A problem has persisted in the conventional devices in that since the illumination or lighting space is confined or small, there is no interesting visual effect in the illumination device installed in the conventional running toy.

SUMMARY OF THE INVENTION

An object of the invention is to provide an illumination mechanism for a toy which achieves an excellent visual effect surpassing that of existing devices.

Another object of the invention is to provide an illumination mechanism for toys capable of displaying patterns on a transparent frame which then become projected onto a projection face of the toy.

These and other objects of the invention are achieved by providing an outer shell of a main body with an illumination face made of a transparent material, and a transparent frame made of a transparent material so as to display desired patterns, with the transparent frame being positioned inside of the outer shell body. A light source is placed in the main body of the toy so that in operation, the patterns displayed on the transparent frame are projected onto the projection face formed on the outer shell of a main body of a toy by means of the light source.

DETAILED DESCRIPTION OF THE PREFERRED EMBODIMENTS

Figure 1:
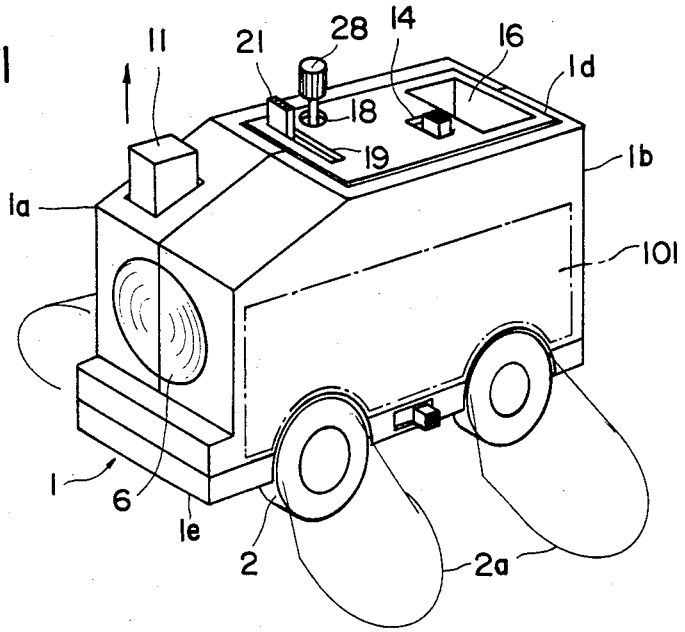
FIG. 1 is a perspective view of the preferred embodiment.
Figure 2:
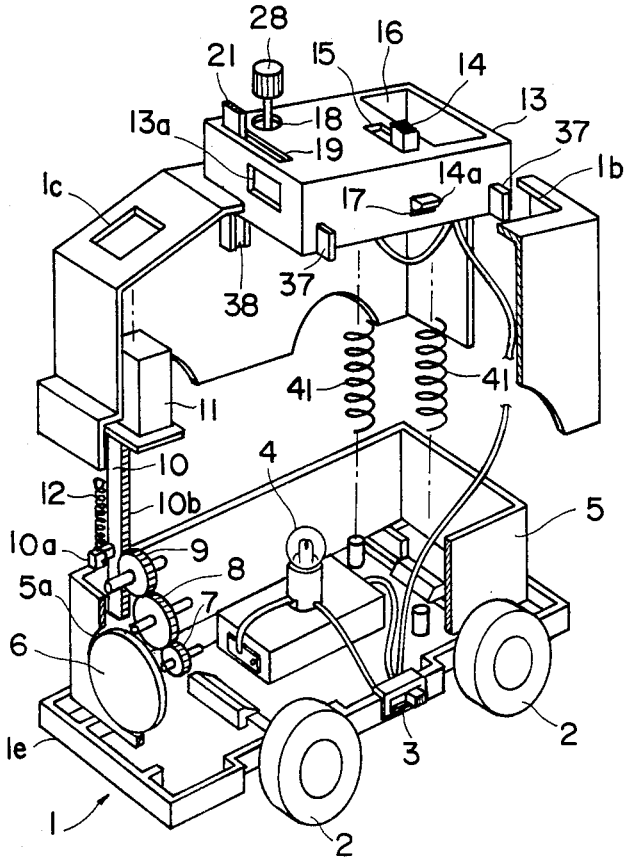
FIG. 2 is a perspective view, partially cutaway and partially exploded, of the embodiment of FIG. 1.

Referring now to FIGS. 1–4, the invention has a main body 1 consisting of a pair of outer shell halves 1*a*, 1*b* divided into two pairs longitudinally and a chassis 1e. These outer shell halves 1*a*, 1*b*, respectively are made of a semi-transparent material of milky white color or a transparent material. Wheels 2, rotatably mounted on the chassis 1*e*, are manufactured of a transparent material so as to illuminate the sides of the main body 1 by means of a light source 4 in the main body, light projection being indicated by lines 2*a*.

On the chassis 1*e*, there is a mini-electric-bulb 4 as a light source. At the side of the chassis 1e, a switch 3 for the light source 4 is placed. There is a transparent frame 5 made of a transparent material having a light passing property on the chassis 1*e*. The transparent frame 5 has a display or illustration of a desired pattern, such as an interior structure of an automobile depicted in scientific fiction.

According to the preferred embodiment of the present invention, a particular construction having a transparent frame 5 is employed; however, it is possible to employ a method in which a film for displaying patterns in place of the transparent frame 5 is bonded to the interior of the outer shell halves 1*a*, 1*b*. The former case has the same effect as that of the latter case.

An opening 1*c* is formed at the upper front portion of the outer shell half 1*a* and a push button 11 is operable in the opening 1*c*. A vertical rod 10 is connected to the push button 11 underneath the push button and a rack 10*b* is formed at the side of the vertical rod 10. The lower end of the pulling spring 12 is hooked at the projection 10*a* formed on the vertical rod 10 and the pulling spring 12 urges the push button 11 upwardly. The rack 10*b* of the vertical rod 10 engages gear 9, gear 9 engages gear 8, and gear 8 engages gear 7. On the end of the gear shaft of the gear 7, a rotating plate 6 is engaged. The rotating plate 6 is rotatably inserted in an opening 5*a* formed on the transparent frame 5. The rotating plate 6 is made of a transparent material and displays a pattern of convolution or vortex.

Consequently, after the light source 4 is lit, pushing operation of the push button 11 rotates the rotating plate 6 to project the patterns of vortex onto the front outer shell halves 1*a*, 1*b* of the main body 1. When the push button 11 returns by means of a pulling spring 12, the patterns of vortex are projected in the opposite direction by rotation of the plate 6 in the opposite direction.

Figure 3:
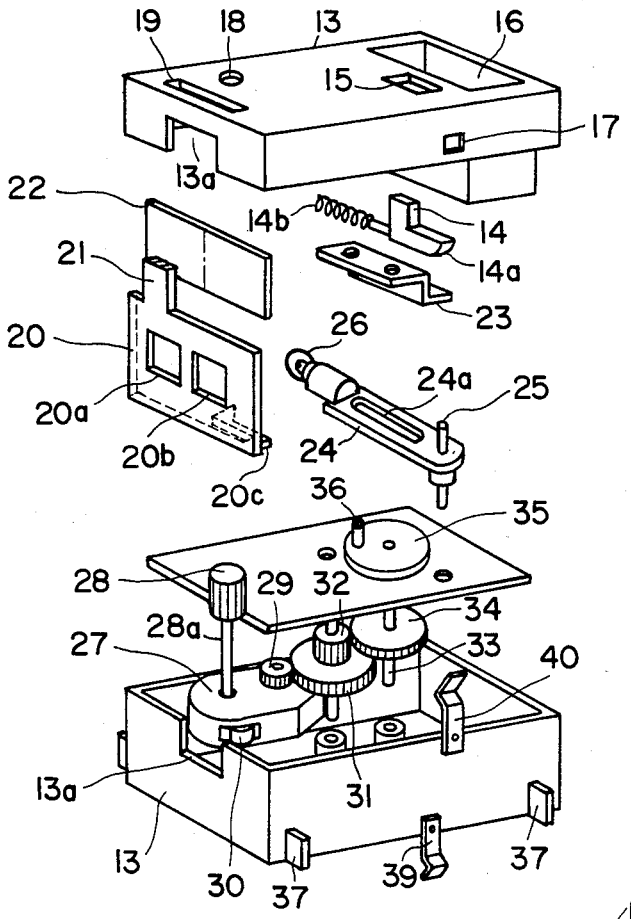
FIG. 3 is a detailed perspective and exploded view showing the inner structure of the elevating machine frame of FIG. 2.
Figure 4:
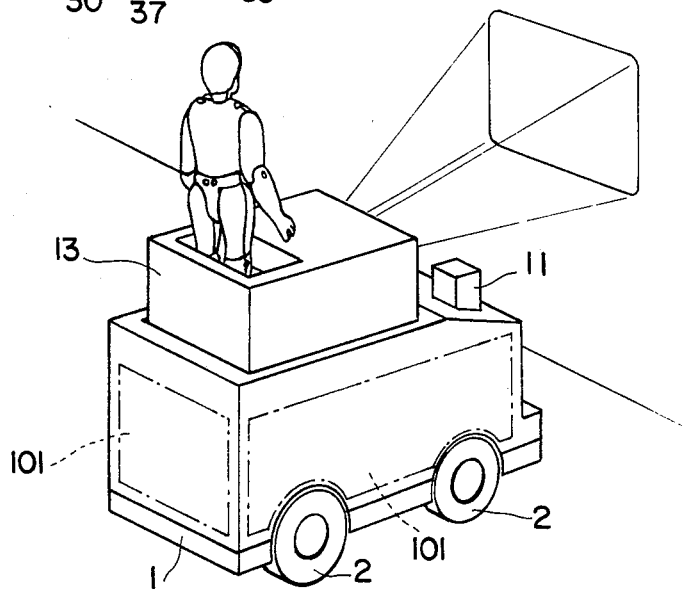
FIG. 4 is a perspective view showing an image projected on a wall by a projecting mechanism of the elevating machine frame of the FIGS. 1–3 embodiment.

On the upper part of the outer shell halves 1*a*, 1*b*, a relatively large opening 1*d* is formed. An elevating frame 13 is vertically movable through the opening 1*d*. A spring machine frame 27, shown in FIG. 3, is placed in the elevating frame 13 and a gear 31 is engaged with an output gear 29 of the spring machine frame 27. A gear 32 is engaged on the same shaft as that of the gear 31 and engages gear 34 placed on the gear shaft 33. A cam 35 is attached on an upper end of the gear shaft 33. A knob 28 is fitted on the upper end of a spring rotating shaft 28*a*. A governor 30 is placed on and extends outwardly from the spring machine frame 27 so that a part of the governor extends outwardly through an opening of the frame 27.

A pair of guide projections 37 on the elevating machine frame 13, are fitted into the guide grooves 38 formed in the interior wall face of the outer shell halves 1*a*, 1*b*. The elevating machine frame 13 is supported on the outer shell halves 1*a*, 1*b* of the main body 1 so as to be able to move up and down. On the upper face of the elevating machine frame 13, a square opening 15 is formed. From or through the square opening 15, a sliding knob 14 projects. The sliding knob 14 is formed substantially in the shape of an inverted "L" and the hooking claw 14*a* at the end of the bent portion is able to rise or project through the opening 17 formed at the side of the elevating machine frame 13. The sliding knob 14 is slidingly guided by a guide member 23 and the pushing spring 14*b* pushes the engaging claw 14*a* out through the opening 17. Pushing springs 41 are placed in the space between the lower portion of the elevating machine frame 13 and the chassis 1*e* and accordingly the machine frame 13 is urged to move vertically by means of the pair of pushing springs 41. Consequently, when the elevating machine frame 13 is pushed from a raised position along a vertical direction against the elasticity of the pushing springs 41 to move the machine frame 13 downwardly, the end of the engaging claw 14*a* projecting through the opening 17 engages with an engaging projection (not shown) formed on the outer shell half 1b to keep the elevating machine frame 13 at its downward position. When the sliding knob 14 is operated to disengage the engagement relationship between the engaging claw 14*a* and the engaging projection (not shown) of the outer shell halve 1*b*, the elevating machine frame 13 is raised due to the elasticity of the pushing springs 41 and 41. Through a concaved portion 16 formed on the upper face of the elevating machine frame 13, a doll or the like is inserted. A knob 28 fitted on the upper end of the spring winding shaft 28*a* is projected through a circular opening 18.

A sliding frame 20 is slidably mounted in front of the interior of the elevating machine frame 13. A pair of square through-openings 20*a*, 20*b* are formed on the sliding frame 20. A film 22 having a left and right frames and displaying a desired pattern, such as a tank or an exploding tank pattern is attached to the sliding frame 20. The knob 21 formed at the upper portion of the sliding frame 20 protrudes upwardly through opening 19 formed on the upper face of the elevating machine frame 13. The front end portion of the L-shaped projection 20*c* formed on the lower portion of the sliding frame 20 engages and disengages the governor 30 of the spring machine frame 27.

A rotating arm 24 is supported so as to rotate around a fulcrum of a small shaft 25 and a light source 26 is attached to the front end of the rotating arm 24. The rotating arm 24 has a slot 24*a* formed therein and a pin 36 is fitted vertically through the slot 24*a*, the pin 36 being formed on the cam 35. When the elevating machine frame 13 is elevated, the light source 26 is lit because of a contact made between electric conductive contact 39 formed on the side of the elevating machine frame 13 and another electric conductive contact 40 formed on the inner wall of the outer shell halve 1*b*. Lighting of the light source 26 makes the images displayed on the film 22 of the sliding frame 20 project onto a wall outside the main body 1 through the opening 13*a* (see FIG. 3), while light source 4 causes images from the frame 5 to be projected onto projection faces 101.

When the sliding frame 20 moves right as shown in FIG. 3 and the front end of the projection 20*c* is separated from the governor of the spring machine frame 27, the spring is released to rotate the cam 35 and the rotating arm 24, so that the light source 26 moves to approach or leave repeatedly from the film 22. Herein, when the pattern or picture to be projected on the wall face is set to that of an exploding tank, the projected pattern changes in intensity to heighten the effect of the explosion.

According to the invention, the illumination mechanism is provided with projection faces of the outer shell body manufactured of a transparent material. A pattern is projected to the transparent frame and to the projection faces in order to change the appearance of the main body.

We claim:

1. A toy apparatus having an illumination mechanism, comprising:

an outer shell connected to a chassis, and having an opening on an upper surface thereof;

a shell light source disposed within the shell;

a switch for selectively powering the light source;

a frame made of transparent material disposed within the shell and having projectable illustrations overlaid thereon;

an elevating frame vertically movable in the outer shell opening; and projector means, carried by the elevating frame, for projecting images to surfaces external of the outer shell.

2. A toy apparatus as recited in claim 1, wherein the projector means comprises:

a sliding frame, mounted within the elevating frame, having a pair of openings;

a film having left and right frames, each displaying a desired projectable image; and a projector light source disposed within the elevating frame.

3. A toy apparatus as recited in claim 1, wherein the projector light source is supported on an oscillating arm for movement towards and away from the sliding frame.

4. A toy apparatus as recited in claim 3, further comprising:

an automatic switch for turning on the projector light source when the elevating frame is elevated.

5. A toy apparatus as recited in claim 4, further comprising oscillating means for oscillating the oscillating arm.

6. A toy apparatus as recited in claim 1, wherein the shell is made of semi-transparent material.

7. A toy apparatus as recited in claim 1, wherein the shell is made of transparent material.

8. A toy apparatus as recited in claim 1, further comprising a plurality of wheels rotatably mounted on the chassis.

9. A toy apparatus as recited in claim 8, wherein the plurality of wheels are made of transparent material and are illuminated by the shell light source.

* * * * *

UNITED STATES PATENT AND TRADEMARK OFFICE

CERTIFICATE OF CORRECTION

PATENT NO. : 4,813,905

DATED : March 21, 1989

INVENTOR(S) : Hidehiko Yamaguchi, Kouich Minami, Nobuo Kobayashi

It is certified that error appears in the above-identified patent and that said Letters Patent is hereby corrected as shown below:

Column 1, line 57, "pairs" should be --parts--.

Column 3, line 42, "lb." should be --16.--.

line 46, "(see Fig. 3)"should be --(see Fig. 4)--.

Signed and Sealed this

Twenty-first Day of November, 1989

*Attest:*

JEFFREY M. SAMUELS

*Attesting Officer* *Acting Commissioner of Patents and Trademarks*